United States Patent [19]

Berluti

[11] 4,274,634

[45] Jun. 23, 1981

[54] TENNIS RACKETS

[76] Inventor: Nando Berluti, No. 8, Piazza Rosselli, 60044 Fabriano, Italy

[21] Appl. No.: 99,194

[22] Filed: Nov. 29, 1979

[30] Foreign Application Priority Data

Sep. 21, 1979 [IT] Italy ..... 50320 A/79

[51] Int. Cl.[3] ..... A63B 49/02; A63B 49/04

[52] U.S. Cl. ..... 273/73 L

[58] Field of Search ..... 273/73 R, 73 C, 73 D, 273/73 E, 73 F, 73 H, 73 L, 67 R, 326

[56] References Cited

U.S. PATENT DOCUMENTS

| | | | |
|---|---|---|---|
| 1,808,035 | 6/1931 | Guenard | 273/73 C X |
| 3,707,288 | 12/1972 | Edlefsen | 273/73 L |
| 3,891,211 | 6/1975 | Diefenbach | 273/73 L |
| 4,066,260 | 1/1978 | Rodgers | 273/73 C |

FOREIGN PATENT DOCUMENTS

| | | | |
|---|---|---|---|
| 1009270 | 4/1977 | Canada | 273/73 L |

*Primary Examiner*—Richard J. Apley
*Attorney, Agent, or Firm*—Haseltine and Lake

[57] ABSTRACT

A tennis racket comprising a base frame consisting of a handgrip and annular support, a counter-frame having a similar shape, an active element carrying crossed strings and adapted to be interchangeably mounted between said base frame and counter-frame and means for fastening to one another said base frame, counter-frame and active element.

2 Claims, 3 Drawing Figures

TENNIS RACKETS

The present invention relates to an improvement in tennis rackets. It is well known that the active or reaction element of the conventional tennis rackets, as at present in use, consists of a string warping carried out of several materials, such as plastic or catgut.

This assembly, although constantly improved, still gives rises to continuous troubles since the decrease of the optimum characteristic of a single string invalidates the profitable use of the racket.

Moreover, all this becomes worse by that the restoration of the racket can not be performed within short or acceptable terms.

Thus, the purpose of the invention is that to avoid said disadvantages.

According to the invention a tennis racket is provided which comprises in combination a base frame, consistng of a handgrip and annular support, a counter-frame having a shape similar to that of said support, a reaction element having a string warping secured to an annular support having a shape similar to that of said frames and means for interchangeably fastening the three elements to one another.

Moreover, according to the invention said fastening means are formed by a series of Allen screws, passing through all the three elements.

In a simplified embodiment, said interchangeable reaction or active element is directly fastened to the base frame.

The invention will be now disclosed with reference to the enclosed drawing which shows an illustrative and not limitative embodiment of the invention itself.

Figure 1:
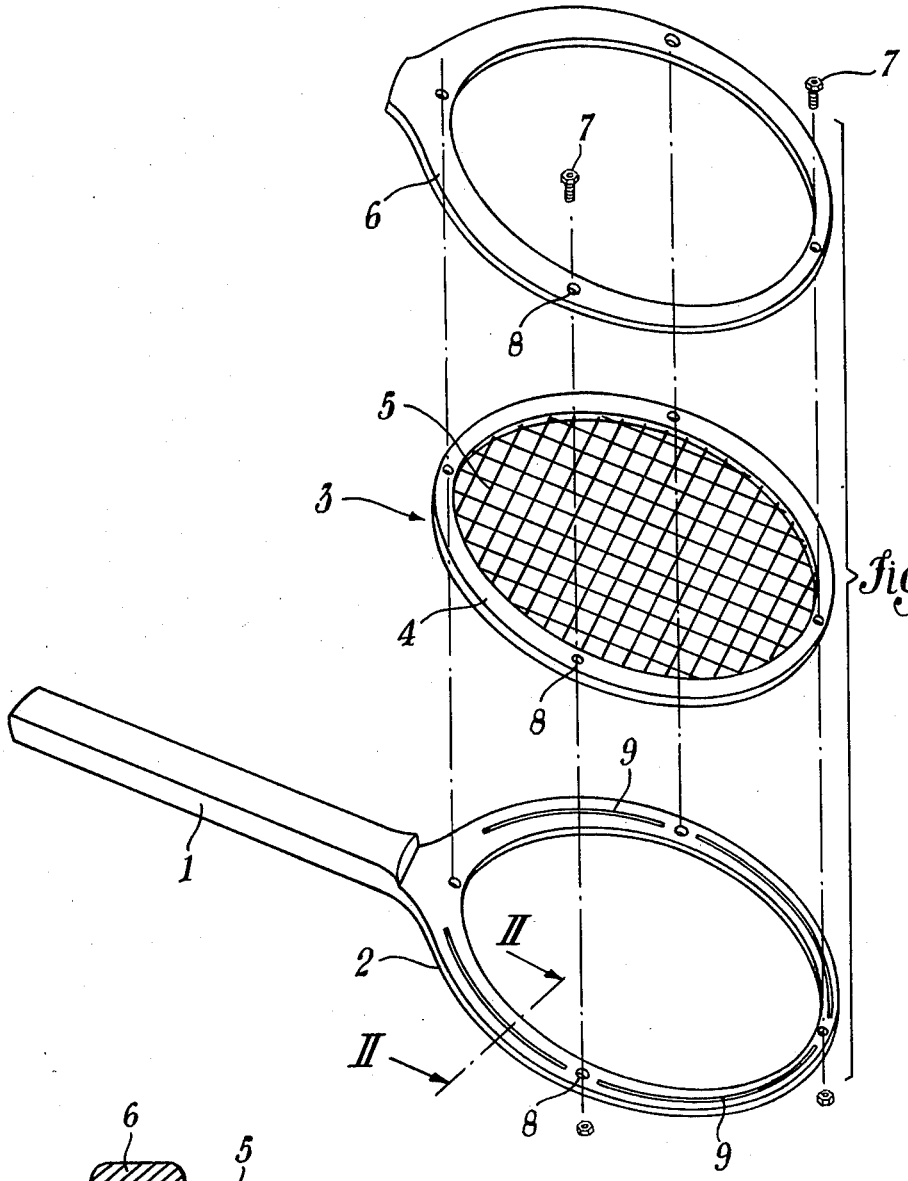
FIG. 1 is an exploded view of the racket according to the present invention.
Figure 2:
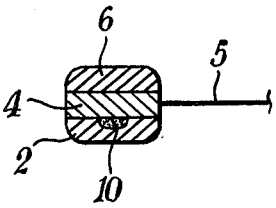
FIG. 2 shows a cross-sectional view along the line II—II in enlarged scale.
Figure 3:
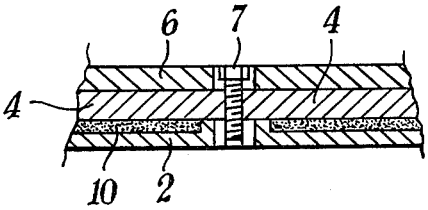
FIG. 3 is a longitudinal section view.

Referring now to the drawing, the invention provides a racket comprising a base frame consisting of a handgrip 1 and annular support 2 having a conventional shape. This element may be carried out of a technologically suitable material.

The inner face of the annular portion 2 of the base frame is flattened and an active or reaction element 3 is placed thereon, which reaction element may be made of a metal material by blanking or punching; of a plastic material, or may consist of an outer rigid frame onto which the strings are applied by the conventional techniques.

Above the reaction element 3 it is arranged a counter-frame 6 having the purpose of integrating the whole shape of the racket.

The entire assembly of said three elements is tightened by Allen screws 7, sunken into the width of the frames and passing through holes 8. From the above said it will be evident that the replacement of the active element 3 may be performed in a simple and quick manner.

The base frame or counter-frame may be provided with grooves 9 into which one or more lead bars 10 may be introduced for attaining a personalized dynamic balancing of the racket.

In a simplified version, the reaction element 3 may be directly fastened to the base frame without the counter-frame.

The advantages attained by the above disclosed tennis racket may be summarized as follows:

(i) Variability of the reaction on the ball owing the modular structure of the racket, or variability of the ball speed according to the material used for manufacturing the active element;

(ii) possibility of the player to dose the proper energies in dependance on the type of the active element as mounted, and to use always the same racket, all this also in accordance with the predetermined counter-balancing thereof.

(iii) constantly enjoying the use of the preferred racket, thus avoiding, in case of a loosening of a string, the disadvantage, at present existing, of replacing such racket with another one, which has not the same tactile perception.

The present invention has been disclosed with reference to a preferred embodiment thereof, it being however understood that several modifications may be performed by a skilled in the art without departing from the scope of the invention.

Having thus described the present invention, what I claim is:

1. A racket comprising a replaceable string-frame, a racket-frame with a handle and a separable counter-frame, said frames having the same shape and a continuous annular periphery, a plurality of Allen screws for fastening said string-frame between said racket-frame and said counter-frame to form a single rigid frame, said screws having their heads sunk in respective holes of said counter-frame, and their shank passing through corresponding holes of said string-frame and screwed in holes of said racket-frame, said holes being uniformly distributed along the annular periphery of said frames, said racket-frame having on its surface abutting said string-frame a peripheral groove between each adjacent hole pairs, said grooves being intended to receive weight elements for balancing the racket.

2. A racket comprising a replaceable string-frame and a racket-frame with a handle, said frames having the same shape and a continuous annular periphery, a plurality of Allen screws for fastening said string-frame to said racket-frame to form a single rigid frame, said screws having their heads sunk in respective holes of said counter-frame, and their shank screwed in holes of said racket-frame, said holes being uniformly distributed along the annular periphery of said frames, said racket-frame having on its surface abutting said string-frame a peripheral groove between each adjacent hole pairs, said grooves being intended to receive weight elements for balancing the racket.

* * * * *